US010493787B2

(12) United States Patent
Pagan

(10) Patent No.: US 10,493,787 B2
(45) Date of Patent: Dec. 3, 2019

(54) BOOK OR BOOK COVER WITH LIGHTPAPER ASSEMBLY

(71) Applicant: Luis Javier Pagan, Dublin, OH (US)

(72) Inventor: Luis Javier Pagan, Dublin, OH (US)

( * ) Notice: Subject to any disclaimer, the term of this patent is extended or adjusted under 35 U.S.C. 154(b) by 0 days.

(21) Appl. No.: 15/971,654

(22) Filed: May 4, 2018

(65) Prior Publication Data

US 2018/0319197 A1 Nov. 8, 2018

Related U.S. Application Data

(60) Provisional application No. 62/501,163, filed on May 4, 2017.

(51) Int. Cl.
*B42D 3/12* (2006.01)

(52) U.S. Cl.
CPC ..... *B42D 3/123* (2013.01)

(58) Field of Classification Search
CPC ..... A47B 23/06; B42D 15/022; B42D 3/123; B42D 3/18
See application file for complete search history.

(56) References Cited

U.S. PATENT DOCUMENTS 4,266,164 A * 5/1981 Schroeder ..... H05B 33/08 315/169.1
4,850,614 A * 7/1989 Shanahan ..... B41L 1/36 462/8
5,381,310 A * 1/1995 Brotz ..... B41M 3/06 362/556
6,637,907 B1 * 10/2003 Levy ..... A47B 19/10 362/156
7,549,762 B2 * 6/2009 Dinnerstein ..... B42D 3/123 362/183
9,683,714 B1 * 6/2017 Gunawan ..... F21V 3/049
2003/0081407 A1 * 5/2003 Bennett, Jr. ..... B42D 3/123 362/98
2003/0086256 A1 * 5/2003 Ip ..... A47B 19/10 362/98
2005/0052860 A1 * 3/2005 Tsai ..... G02B 6/0083 362/97.3
2007/0210571 A1 * 9/2007 Gill ..... B42D 1/08 281/29
2010/0109314 A1 * 5/2010 Stravinskas ..... A63H 33/38 281/38
2016/0159133 A1 * 6/2016 Hudachek ..... B42D 3/123 281/29
2018/0213904 A1 * 8/2018 Pagan ..... A45C 11/36

* cited by examiner

*Primary Examiner* — David R Dunn
*Assistant Examiner* — Christopher E Veraa
(74) *Attorney, Agent, or Firm* — Renner, Otto, Boisselle & Sklar, LLP

(57) ABSTRACT

A book includes a book cover, pages operably attached to the book cover, and a sheet of lightpaper pivotably attached to an edge of the book cover. The lightpaper sheet, when lit and inserted behind a page may provide light through the page for a user to read or write on the page even in a dark room or in a room without otherwise appropriate lighting.

20 Claims, 5 Drawing Sheets

BOOK OR BOOK COVER WITH LIGHTPAPER ASSEMBLY

BACKGROUND

This disclosure generally relates to books and book covers.

Books may generally comprise sheets of paper between a cover and connected by a binding mechanism. Book covers may comprise rigid or flexible, natural and/or synthetic materials. Books, including notebooks, may be convenient for writing and reading. However, books may be difficult to write or read on in a space room or in a space without appropriate lighting. Therefore, different books and book covers that deal with this issue are desirable.

SUMMARY OF THE INVENTION

The present disclosure provides a book and book cover that includes a lightpaper. A lightpaper sheet may be attached to the book cover and foldable so as to be pivotable about an axis along the edge of the book cover. For example, the sheet of lightpaper may be flexible so as to be pivotable about the axis along the attachment between the sheet of lightpaper and the edge of the book cover. This way, the lightpaper sheet that forms part of the book assembly may be inserted behind a page of the book. The lightpaper sheet, when inserted behind a page and lit may provide light through the page for a user to read or write on the page even in a dark room or in a room without otherwise appropriate lighting.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

FIG. 3A illustrates a perspective view of the exemplary book assembly opened to exposed pages and lightpaper sheet folded in.

FIG. 3B illustrates a bottom view of the exemplary book assembly opened to exposed pages and lightpaper sheet folded in.

DETAILED DESCRIPTION

Figure 1:
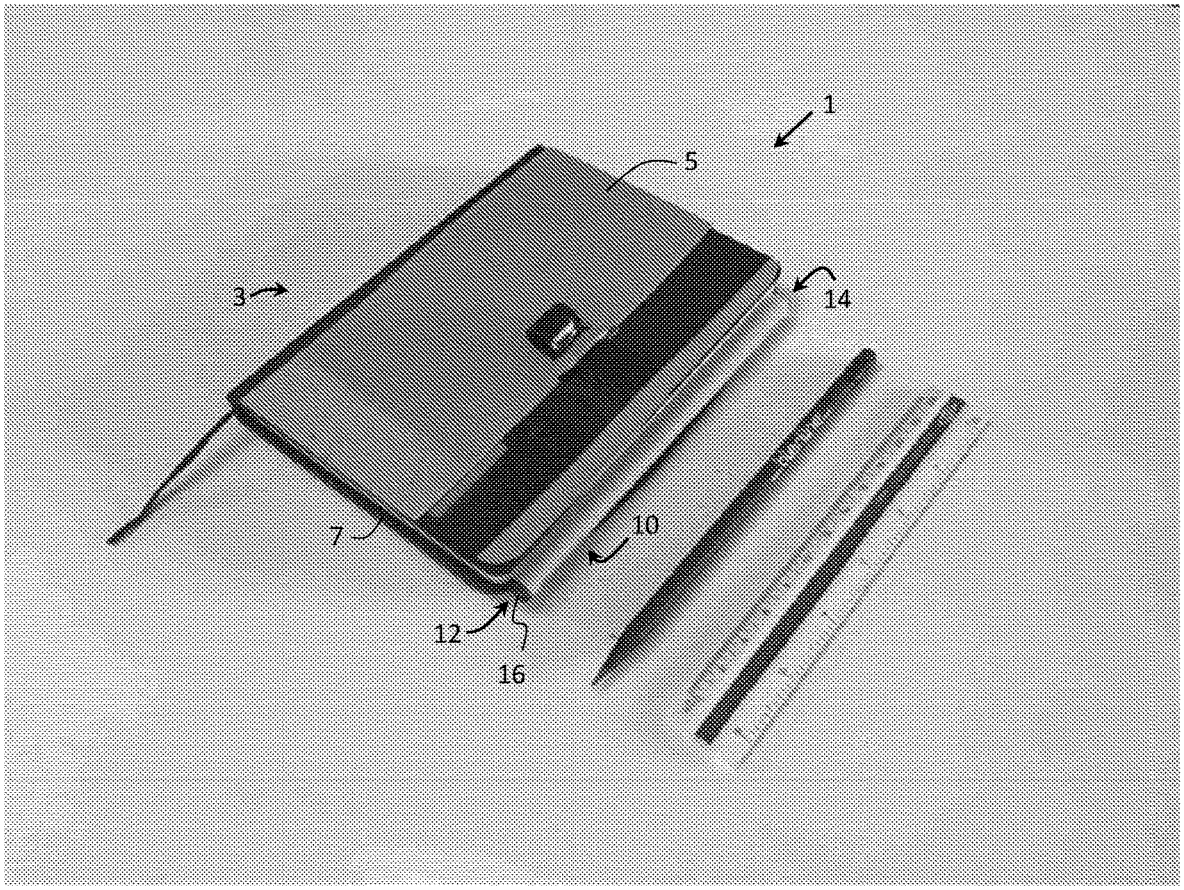
FIG. 1 illustrates a front perspective view of an exemplary book assembly.
Figure 2:
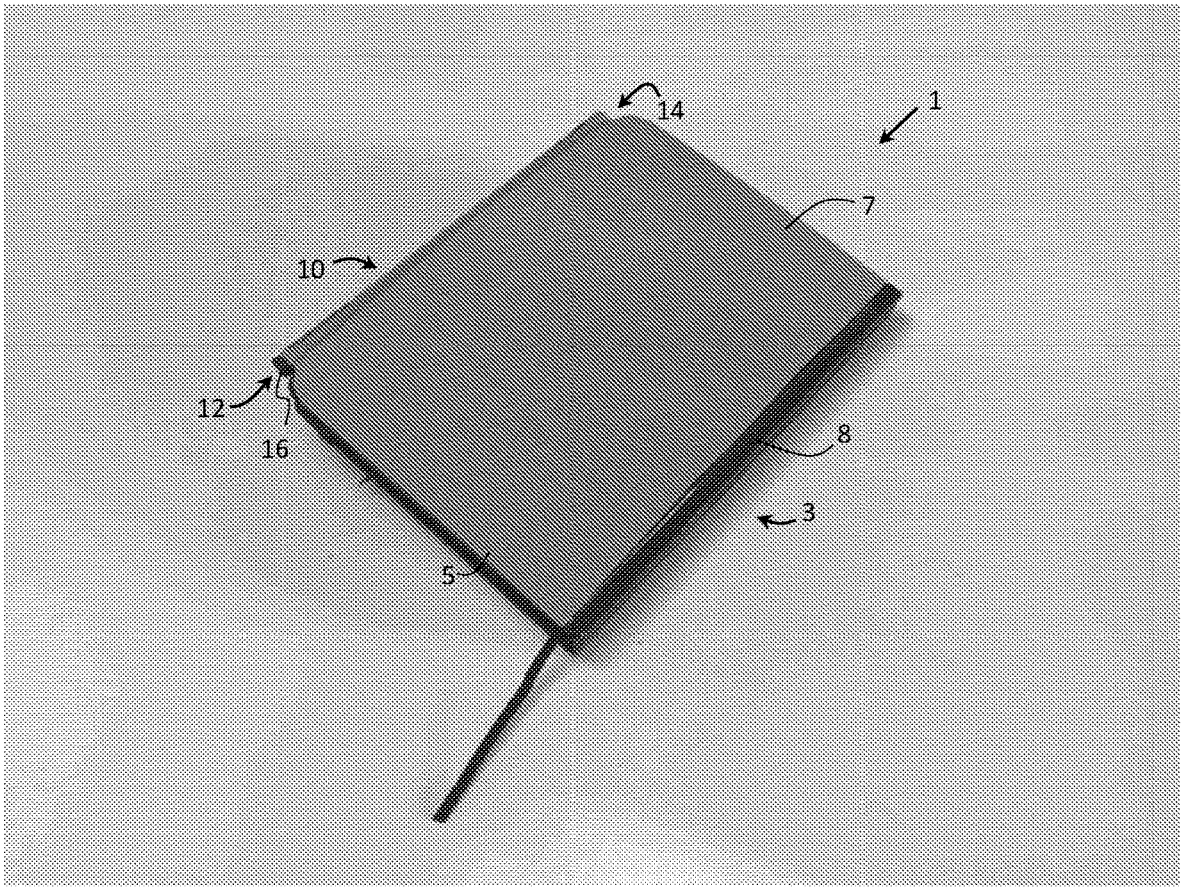
FIG. 2 illustrates a back perspective view of the exemplary book assembly.

FIGS. 1-5B illustrate an exemplary book assembly 1 according to the present invention. As best shown in FIGS. 1 and 2, the book assembly 1 may include a book cover 3, which itself may include a front cover 5, a back cover 7, and a spine 8. As best shown in FIGS. 3A-5B, in the illustrated embodiment, the book assembly 1 may also include pages 9 that are attached to the book cover 3.

In one embodiment, the book cover 3 may be provided without pages and the pages 9 may be added in the form of a book or notebook that attaches to the book cover 3 to form the book assembly 1. The book cover 3 may, for example, include attachment pockets as part of the front cover 5 and the back cover 7. Front and back covers of the attached book may be inserted in the front and back pockets of the book cover 3 to attach the book to the book cover 3 and form the book assembly 1. This way, when such a book has been read completely, the book may be detached from the book cover 3 and the book cover 3 reused on a different book or notebook. In another embodiment, the pages 9 may be loose pages and the book cover 3 may include openable rings or other mechanism to hold and release the pages 9. This way, when such pages 9 have all been used, the pages may be detached from the book cover 3 and the book cover 3 reused by adding new loose pages.

As best shown in FIGS. 3A-5B, the book assembly 1 may also include a lightpaper assembly 10, which includes a sheet of lightpaper 11 pivotably attached to an edge of the book cover 3. Lightpaper typically includes small (e.g., diameter=5 μm, 10 μm, 25 μm, 50 μm, 100 μm, etc., height=1 μm, 2 μm, 5 μm, 10 μm, 25 μm, etc.) light emitting diodes (LED) sometimes known as MicroLED printed on a layer which is sandwiched between two other layers and sealed. The small LED may be evenly or randomly dispersed throughout the lightpaper such that, when current is applied to them, the lightpaper lights up and irradiates light. In one embodiment, the lightpaper sheet 11 is a sheet of lightpaper material as commercialized by Rohinni LLC of Coeur d'Alene, Idaho. Other manufacturers of MicroLED technology usable to manufacture lightpaper may include Lumiode, VerLASE, VersufleX, Veeco, LuxVue, eLux, VueReal, X-Celeprint, CEA-Leti, OKI, PlayNitride, Mikro Mesa, and TSMC.

The lightpaper sheet 11 may be attached to the book cover 3 and foldable so as to be pivotable about an axis along the edge of the book cover. For example, as shown in FIGS. 3A-5C, the sheet of lightpaper 11 is flexible so as to be pivotable about the axis a along the attachment between the sheet of lightpaper 11 and the edge of the book cover 3. This way, the lightpaper sheet 11 that forms part of the book assembly 1 may be inserted behind a page 9*b* of the book assembly 1 (i.e., between pages 9*a* and 9*b*). Pages 9 made from paper are usually at least somewhat translucent or semitransparent. In one embodiment, the pages 9 are regular paper pages. In another embodiment, the pages 9 are semitransparent tracing paper pages. In yet another embodiment, the pages 9 are transparent pages. The lightpaper sheet 11, when inserted behind the page 9*b* and lit may provide light through the page 9*b* for a user to read or write on the page 9*b* even in a dark room or in a room without otherwise appropriate lighting.

Figure 3A:
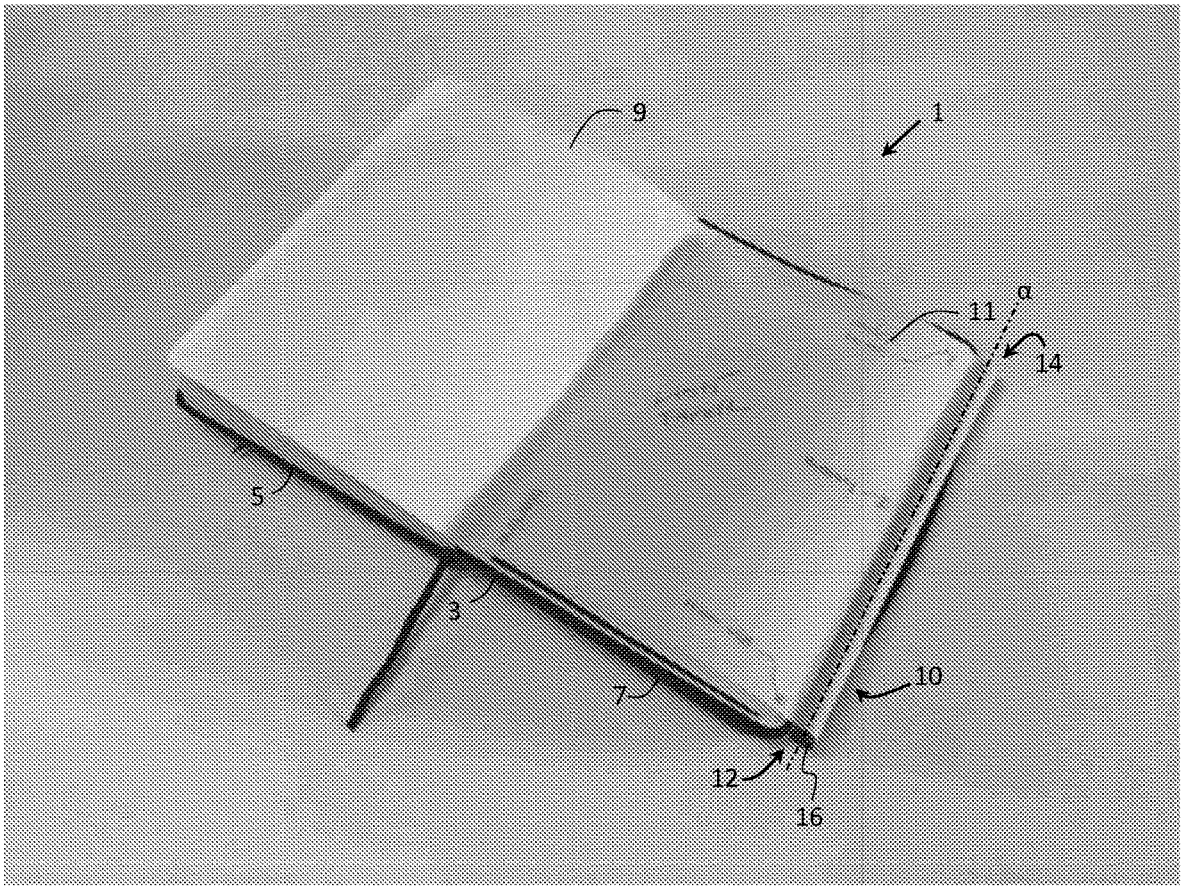
Figure 3B:
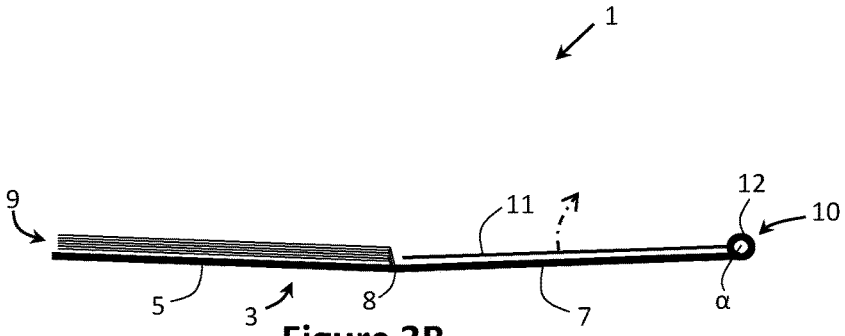
Figure 4A:
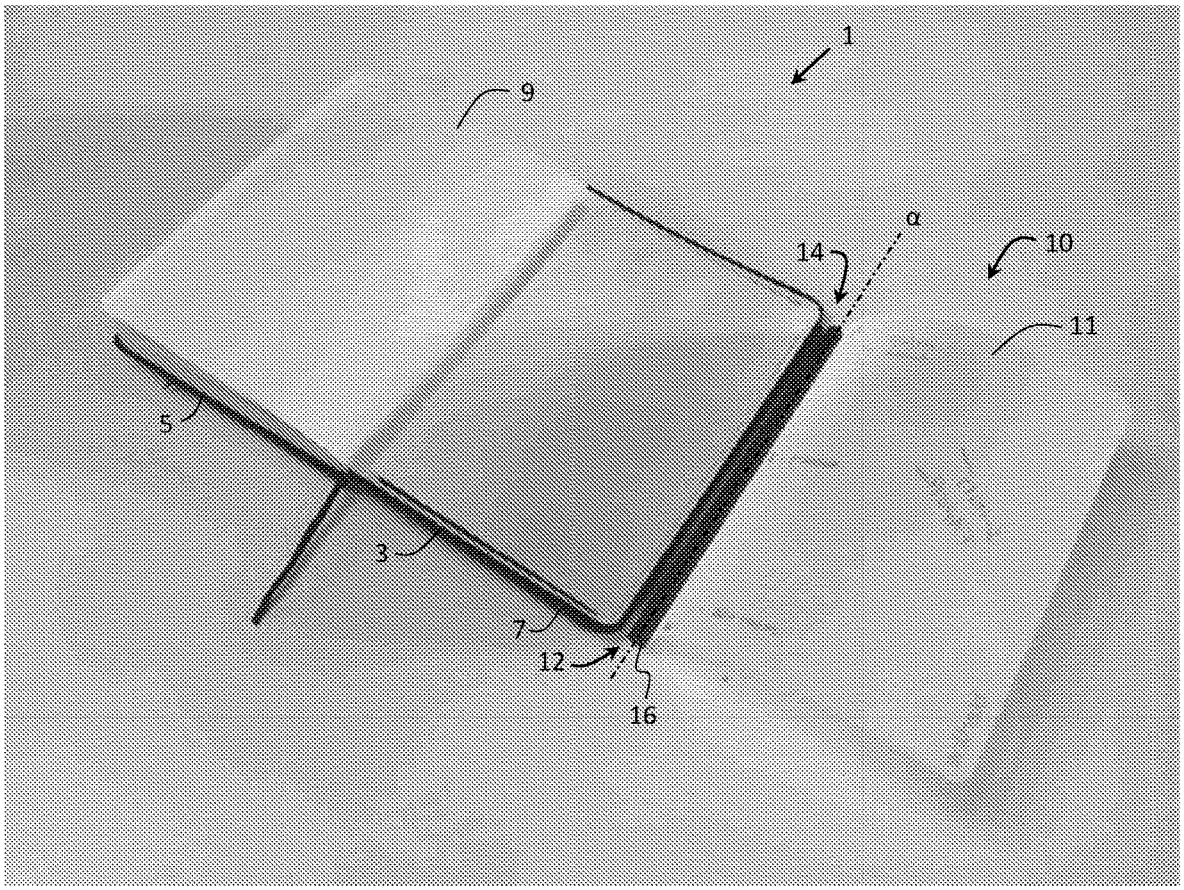
FIG. 4A illustrates a perspective view of the exemplary book assembly opened to exposed pages and lightpaper sheet folded out.
Figure 4B:
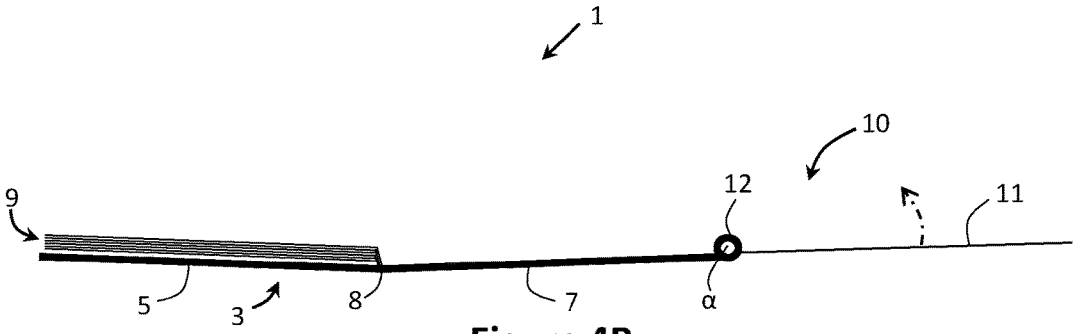
FIG. 4B illustrates a bottom view of the exemplary book assembly opened to exposed pages and lightpaper sheet folded out.
Figure 5A:
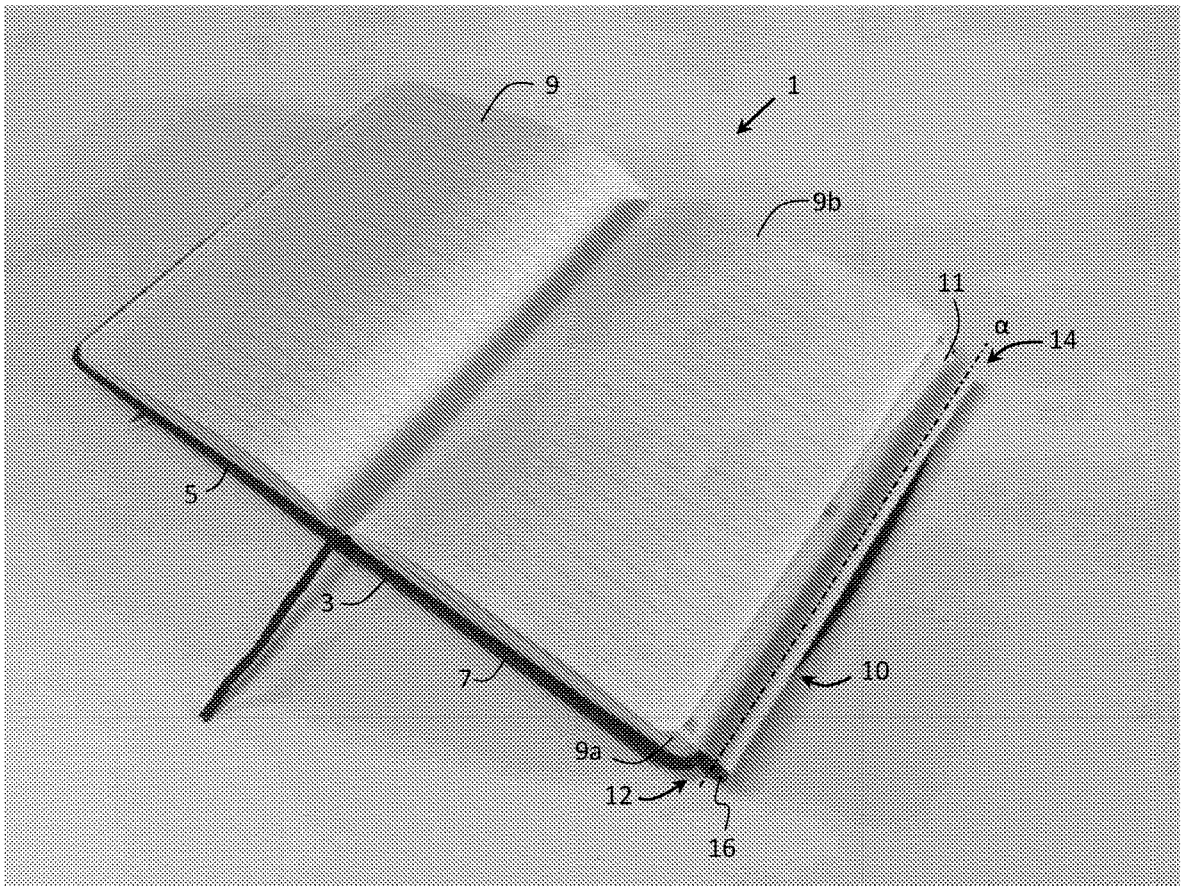
FIG. 5A illustrates a perspective view of the exemplary book assembly opened to exposed pages and lightpaper sheet folded in behind a page.
Figure 5B:
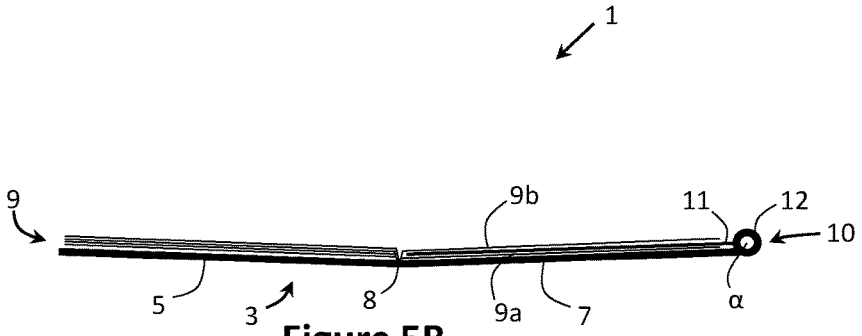
FIG. 5B illustrates a bottom view of the exemplary book assembly opened to exposed pages and lightpaper sheet folded in behind a page.

FIGS. 3A and 3B illustrate the lightpaper sheet 11 attached to the back cover 7 of the book assembly 1 and folded in, adjacent the back cover 7. FIGS. 4A and 4B illustrate the lightpaper sheet 11 attached to the back cover 7 and folded out of the book assembly 1. FIGS. 5*a* and 5B illustrate the lightpaper sheet 11 inserted between two pages 9*a*, 9*b* of the book assembly 1. Although in the illustrated embodiment the lightpaper sheet 11 is shown attached to the side edge of the back cover 7, in other embodiments the lightpaper sheet 11 may be attached to the top or bottom edge of the back cover 7 or to the side, top, or bottom edge of the front cover 5.

The lightpaper assembly 10 of the book cover 3 may also include a battery holder 12 electrically connected to the sheet of lightpaper 11 to hold batteries (e.g., AA, AAA, etc.) that power the lightpaper sheet 11. The battery holder 12 may be disposed between the sheet of lightpaper 11 and the edge of the book cover 3 to which the lightpaper sheet 11 connects. This way, the sheet of lightpaper 11 may be operably attached to the edge of the book cover 3 by the battery holder 12. The battery holder 12 may also include an on-off switch 14 operably connected to the sheet of lightpaper 11 and the batteries to control on-off of the sheet of lightpaper 11. The battery holder 12 may also include a charger outlet 16 (e.g., USB, MicroUSB, etc.) to charge the batteries in the battery holder 10.

In the illustrated embodiment, the battery holder 12 is shown disposed between the sheet of lightpaper 11 and the edge of the book cover 3 to which the lightpaper sheet 11 connects (i.e., the lightpaper assembly 10 is attached to the side edge of the book cover 3). In other embodiments, the battery holder 12 may be disposed in the spine 8, the front cover 5, or the back cover 7 of the book assembly 1.

In one embodiment, the lightpaper assembly 10 may include the lightpaper sheet 11 and the battery holder 12, and not be part of the book cover 3. The lightpaper assembly 10 may be used to insert the lightpaper sheet 11 behind a page of a book to provide light to the page as described above. The lightpaper assembly 10 may also include means (e.g., clips, elastic band, etc.) for attaching to the front or back cover of a book. This way, the lightpaper sheet 11 may be inserted behind a page of a book to provide light to the page as described above.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the terms "in" or "into" are used in the specification or the claims, it is intended to additionally mean "on" or "onto." Furthermore, to the extent the terms "connect" or "attach" are used in the specification or claims, it is intended to mean not only "directly connected to" or "directly attached to" but also "indirectly connected to" "indirectly attached to" such as connected through another component or components. An "operable connection," or a connection by which entities are "operably connected" or "operably attached" is one by which the operably connected entities or the operable connection perform its intended purpose. For example, two entities may be operably connected to each other directly or through one or more intermediate entities.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A book comprising:

a book cover;

pages operably attached to the book cover; and a sheet of lightpaper configured to irradiate light when activated and having an edge thereof pivotably attached to an edge of the book cover such that the sheet of lightpaper is pivotable about an axis along the edge of the sheet of lightpaper and the edge of the book cover, the sheet of lightpaper insertable between two of the pages, the sheet of lightpaper pivotable about the axis to at least three pivotal positions including:

a first pivotal position in which the sheet of lightpaper is folded in immediately adjacent the book cover with none of the pages between the sheet of lightpaper and the book cover, a second pivotal position in which the sheet of lightpaper is folded out of the book, and a third pivotal position in which the sheet of lightpaper is folded back in between two of the pages such that the light irradiates from behind a top page from the two pages to provide back light through the top page.

2. A book comprising:

a book cover;

pages operably attached to the book cover; and a sheet of lightpaper having an edge thereof pivotably attached to an edge of the book cover to restrict pivoting of the sheet of lightpaper to pivoting about an axis along the edge of the book cover, the book configurable to at least three modes including:

a first mode in which the sheet of lightpaper is pivoted in about the edge of the book cover to be immediately adjacent the book cover with none of the pages in between the sheet of lightpaper and the book cover, a second mode in which the sheet of lightpaper is pivoted about the edge of the book cover to be out of the book in between none of the pages or the book cover, and a third mode in which the sheet of lightpaper is pivoted back in about the edge of the book cover to be between a top page and a bottom page of the pages such that light from the lightpaper irradiates through the top page to provide back light to the top page.

3. The book of claim 2, further comprising:

a battery holder disposed between the sheet of lightpaper and the edge of the book cover such that the sheet of lightpaper is operably attached to the edge of the book cover by the battery holder, the battery holder electrically connected to the sheet of lightpaper.

4. The book of claim 2, further comprising:

a battery holder disposed between the sheet of lightpaper and the edge of the book cover such that the sheet of lightpaper is operably attached to the edge of the book cover by the battery holder, the battery holder electrically connected to the sheet of lightpaper, wherein the battery holder includes an on-off switch operably connected to the sheet of lightpaper to control on-off of the sheet of lightpaper.

5. The book of claim 2, further comprising:

a front cover, a back cover, and a spine; and a battery holder disposed in the spine, the front cover, or the back cover, the battery holder electrically connected to the sheet of lightpaper.

6. The book of claim 2, further comprising:

a front cover, a back cover, and a spine; and a battery holder disposed in the spine, the front cover, or the back cover, the battery holder electrically connected to the sheet of lightpaper, wherein the battery holder includes an on-off switch operably connected to the sheet of lightpaper to control on-off of the sheet of lightpaper.

7. The book of claim 2, wherein the sheet of lightpaper is operably attached to a top edge of the book cover.

8. The book of claim 2, wherein the sheet of lightpaper is operably attached to a bottom edge of book cover.

9. The book of claim 2, wherein the sheet of lightpaper is operably attached to a side edge of the book cover.

10. The book of claim 2, wherein the sheet of lightpaper is flexible so as to be pivotable about an axis along the attachment between the sheet of lightpaper and the edge of the book cover.

11. The book of claim 2, wherein the sheet of lightpaper is flexible so as to be pivotable about an axis along the operable attachment between the sheet of lightpaper and the edge of the book cover and insertable between two of the pages.

12. A book cover comprising:

a front cover;

a back cover operably connected to the front cover; and a sheet of lightpaper having an edge pivotably attached to one of an edge of the front cover or an edge of the back covens such that pivoting of the sheet of lightpaper is limited to pivoting about an axis parallel to the one of the edge of the front cover or the edge of the back cover, the sheet of lightpaper pivotable to at least three modes including:

a first mode in which the sheet of lightpaper is pivoted in about the one of the edge of the front cover or the edge of the back cover to be immediately adjacent the one of the edge of the front cover or the edge of the back cover, a second mode in which the sheet of lightpaper is pivoted about the one of the edge of the front cover or the edge of the back cover to be out of the book cover, and a third mode in which the sheet of lightpaper is pivoted back in about the one of the edge of the front cover or the edge of the back cover.

13. The book cover of claim 12, further comprising:

a battery holder disposed between the sheet of lightpaper and the one of the edge of the front cover or the edge of the back cover such that the sheet of lightpaper is operably attached to the one of the edge of the front cover or the edge of the back cover by the battery holder, the battery holder electrically connected to the sheet of lightpaper.

14. The book cover of claim 12, further comprising:

a battery holder disposed between the sheet of lightpaper and the one of the edge of the front cover or the edge of the back cover such that the sheet of lightpaper is operably attached to the one of the edge of the front cover or the edge of the back cover by the battery holder, the battery holder electrically connected to the sheet of lightpaper, wherein the battery holder includes an on-off switch operably connected to the sheet of lightpaper to control on-off of the sheet of lightpaper.

15. The book cover of claim 12, further comprising:

a spine; and a battery holder disposed in the spine, the front cover, or the back cover, the battery holder electrically connected to the sheet of lightpaper.

16. The book cover of claim 12, further comprising:

a spine; and a battery holder disposed in the spine, the front cover, or the back cover, the battery holder electrically connected to the sheet of lightpaper, wherein the battery holder includes an on-off switch operably connected to the sheet of lightpaper to control on-off of the sheet of lightpaper.

17. The book cover of claim 12, wherein the sheet of lightpaper is operably attached to a top edge of the front cover or a top edge of the back cover.

18. The book cover of claim 12, wherein the sheet of lightpaper is operably attached to a bottom edge of the front cover or a bottom edge of the back cover.

19. The book cover of claim 12, wherein the sheet of lightpaper is operably attached to a side edge of the front cover or a side edge of the back cover.

20. The book cover of claim 12, wherein the sheet of lightpaper is flexible so as to be pivotable about an axis along the operable attachment between the sheet of lightpaper and the one of the edge of the front cover or the edge of the back cover.

* * * * *